US005862544A

United States Patent [19]

Placencia

[11] Patent Number: 5,862,544

[45] Date of Patent: Jan. 26, 1999

[54] APPARATUS FOR RECAPTURE OF IDLE SHOWER WATER

[76] Inventor: Gilbert J. Placencia, 726 A N. 94th St., Seattle, Wash. 98103

[21] Appl. No.: 941,765

[22] Filed: Sep. 30, 1997

Related U.S. Application Data

[60] Provisional application No. 60/026,999, Oct. 7, 1996.

[51] Int. Cl.[6] ..... A47K 3/22

[52] U.S. Cl. ..... 4/597; 4/605

[58] Field of Search ..... 4/597, 605

[56] References Cited

U.S. PATENT DOCUMENTS

| | | | |
|---|---|---|---|
| 3,847,159 | 11/1974 | Hofer | 239/507 |
| 4,893,364 | 1/1990 | Keeler | 4/597 |
| 4,924,536 | 5/1990 | Houghton | 4/665 |
| 5,140,714 | 8/1992 | Horenstein et al. | 4/597 |
| 5,165,456 | 11/1992 | Woolman | 141/98 |
| 5,243,719 | 9/1993 | McDonald et al. | 4/665 |
| 5,274,860 | 1/1994 | Avila | 4/615 |
| 5,285,537 | 2/1994 | Hanks | 4/597 |
| 5,293,654 | 3/1994 | Castwall et al. | 4/598 |
| 5,309,582 | 5/1994 | Henkin et al. | 4/603 |
| 5,341,529 | 8/1994 | Serrano | 4/665 |
| 5,345,625 | 9/1994 | Diemand | 4/665 |
| 5,353,448 | 10/1994 | Lee | 4/597 |
| 5,406,657 | 4/1995 | Donati | 4/665 |
| 5,425,146 | 6/1995 | Serrano | 4/665 |
| 5,522,096 | 6/1996 | Brown | 4/665 |
| 5,557,812 | 9/1996 | Sayant | 4/665 |

*Primary Examiner*—Robert M. Fetsuga
*Attorney, Agent, or Firm*—Kathleen T. Petrich

[57] ABSTRACT

Apparatus for recapture of fresh water flow released from a shower head (12). The collection device (10) includes a supported frame (18) that is proximate the shower head (12) and adjacent a wall (16) to which the shower head (12) is ultimately attached. The device (10) also includes a movable water flow diverter assembly (32), capable of being moved from a first in use position to a second at rest position, and at least one collection container (24) that is supported by the frame (18). The moveable water flow diverter assembly (32) is connected to an upper portion of the frame (20) by a pin (34). Diverter assembly (32) includes an arm (36, 36'), and a collection basin (38) that is connected to arm (36, 36') and a flow director (42) that directs the water flow to the at least one collection container (24, 24').

20 Claims, 6 Drawing Sheets

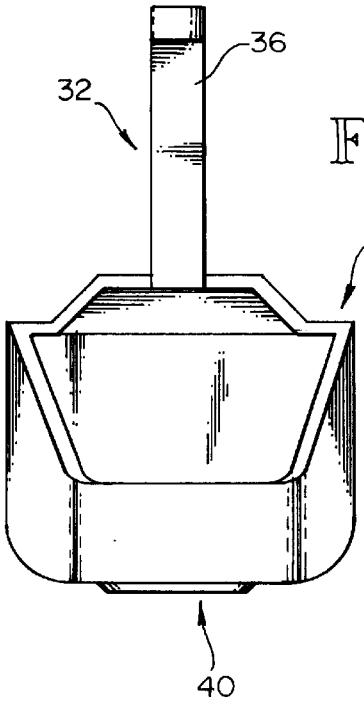
FIG. 7
FIG. 8
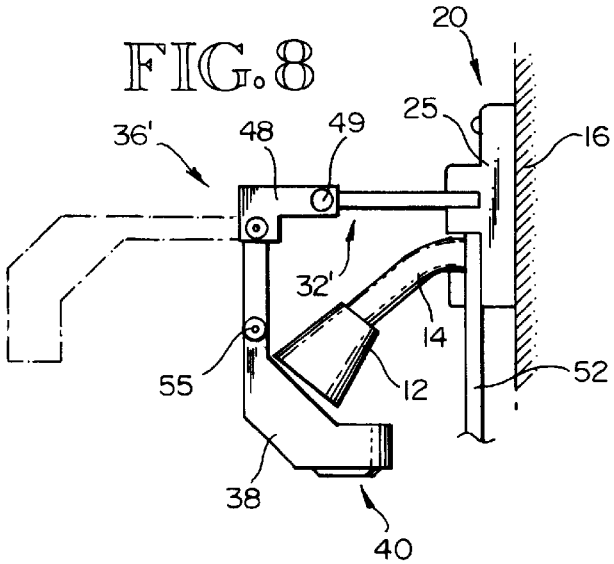
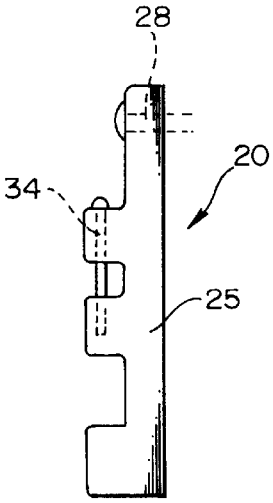
FIG. 6

FIG. 9
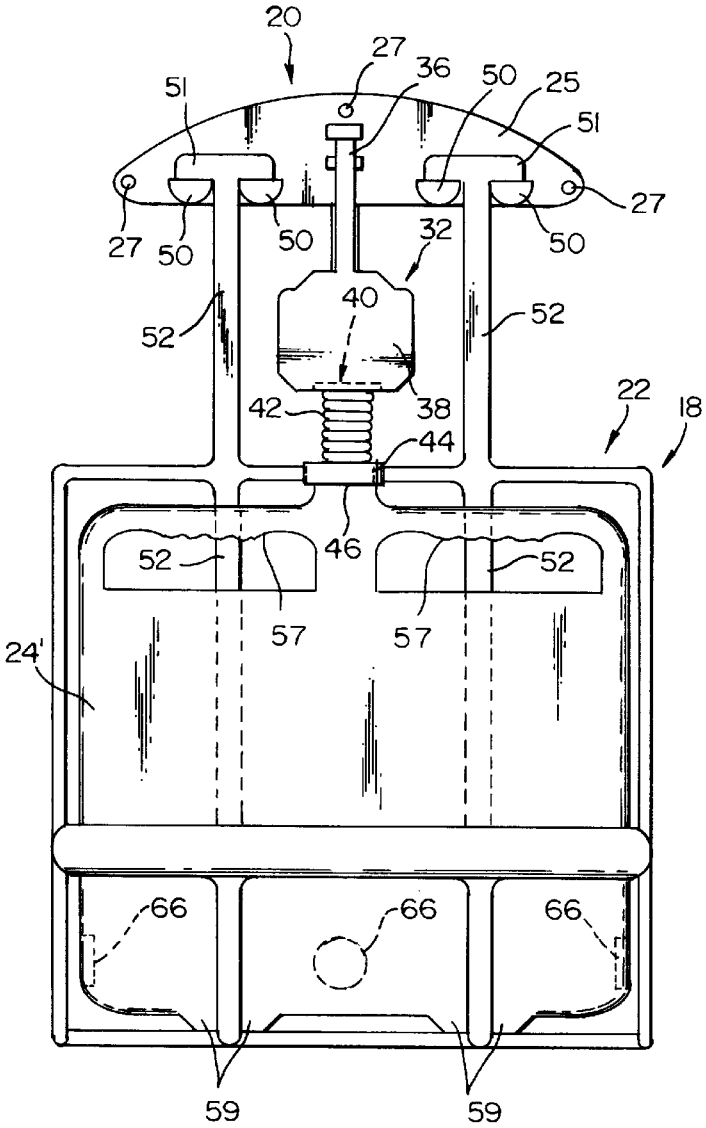
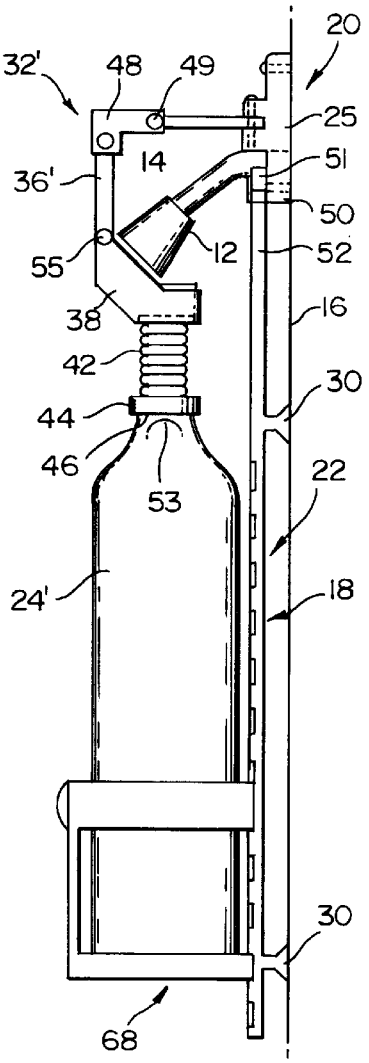
FIG. 10

APPARATUS FOR RECAPTURE OF IDLE SHOWER WATER

RELATED APPLICATION

This application claims priority to my U.S. Provisional Application Ser. No. 60/026,999, filed Oct. 7, 1996, and entitled, "Apparatus and Method for Diverting, Capturing and Recycling Idle Shower Water in Existing Residential and Commercial Housing," which is hereby incorporated by reference.

TECHNICAL FIELD

The present invention relates to fresh water recapture of idle shower water. The retrofittable device includes a frame that supports at least one collection bottle, and a diverter assembly that diverts, channels, and collects the idle shower water into the collection bottles.

BACKGROUND OF THE INVENTION

It is estimated that only a minuscule percentage of all water on earth is fresh water. And of the fresh water that exists on the earth, only a fraction of 1% is available for use since most of the water is locked up in ice and snow masses and is not readily available. In a 1990 U.S. Geological Survey, the average U.S. resident uses in excess of 100 gallons per day for publicly supplied water and approximately 79 gallons per day for each person using his or her own water system.

It is also estimated that 32% of this estimated water consumption is used for showering. Waiting for cold shower water to warm-up to a desired temperature accounts for much of the idle time. As any unused shower water that falls into the drain is channeled into the sewer system, there is no natural recapture of fresh water used in showering. At 60 psi water flow, a single minute of idle shower flow will waste approximately two gallons of fresh water.

The recapture of fresh water during showering has been addressed in complex piping systems in new construction or major remodel projects. However, there are few economically feasible recourses for the average consumer beyond using a "low-flow" shower head with an external diverter in order to reduce unnecessary waste of fresh water. However, the turning on and off of the shower head during shampooing can prove to be complicated and unsatisfactory as the water temperature may not be adequately stabilized (i.e. that which the bather had become accustomed).

An object of the present invention is to provide an economical and easy-to-use fresh water recapture device that can divert, collect, and store fresh water used in a period when the bather does not require the water, such as during water temperature adjustment or during shampooing. It is an additional object of the present invention to also provide a aesthetically-pleasing, relatively unobtrusive, and functional device that can function as a caddy for shampoo, wash cloths, and the like.

DISCLOSURE OF THE INVENTION

The present invention relates to both apparatus and method for recapture of idle shower water. The apparatus claims are directed to a collection device for recapture of a flow of fresh water released from a shower head, wherein the shower head extends outwardly from a shower arm attached to a wall. The device comprises a supported frame, a movable water flow diverter assembly, and at least one collection container. The supportive frame is proximate the shower head and adjacent the wall. The frame includes an upper and lower portion, wherein the lower portion extends downwardly below the shower head. The lower portion is of a size and shape to receive the at least one collection container.

The moveable water flow diverter assembly includes a first "in use" position and a second "at rest" position. The diverter assembly includes an arm that is connected to an upper portion of the frame, a collection basin connected to the arm, and a flow director that directs the water flow from the basin to the at least one collection container. The basin extends downwardly and inwardly of the arm and is of a size and shape to surround the portion of the shower head from which the water is released when the arm is positioned around the shower head in order to divert and direct water into a lower portion of the basin and into the flow director.

Each container includes an opening that is engageable with the flow director such that any diverter water remains uncontaminated as it is collected into the container through the opening when the diverter assembly is in its first position.

In use, a user moves the diverter assembly into the first position wherein the basin diverts the flow of water from the shower head and such diverted flow of water is stored in the at least one container for later use. Alternatively, when the user needs access to the flow of water, the user then moves the diverter assembly into the second position where the basin is moved away from the shower head and does not divert the flow of water.

According to one embodiment, the flow director includes a flexible pipe having a proximal end engaged with an aperture within said collection basin and a seal at the pipe's distal end to engage with the opening of the at least one collection container. In preferred form, the flexible pipe is corrugated to allow the pipe to vary in length.

Preferably, the arm of the water flow diverter assembly is rotatably connected to the upper portion of the frame. Also, it is preferred that the frame is rigidly attached to the wall.

In another embodiment, the collection basin of the water flow diverter assembly may be pivotally attached to the arm in order to have the basin face the wall when the diverter assembly is in the second position.

The present invention also provides for a functional, aesthetically-pleasing housing that attaches to the frame and covers the at least one collection container. In one embodiment, the housing includes a hood that includes a flanged opening. The hood covers the housing such that the external portion of the flange opening engages with the seal of the flexible pipe and the internal portion of the flanged opening is proximate the opening of the at least one container. In yet another embodiment, the hood may include an operably hinged front door.

In yet another embodiment of the housing, the housing may include oppositely situated spaced-apart handles that extend externally of the housing for easy placement and removal of the housing and frame. Also, the housing may include an exterior pocket structure of a size and shape to hold at least one shampoo bottle and the like. Likewise, the housing may also include a rack for holding a wash cloth and the like.

In yet another embodiment of the invention, the housing may include a planar base such that the entire housing and frame may be inherently stable when set down on a flat surface. Also, the housing may include a plurality of frangible openings that correspond to frangible openings in the at least one collection container for access through a water spout and the like.

The present invention provides for various collection containers. In one embodiment, each water bottle may hold up to about approximately 1 gallon. Alternatively, one container may be used that holds approximately three gallons. If all the bottles are full, the weight would be such that the frame must support a heavy load. To that end, the present invention provides for at least two rigid elongated rods that suspend from the upper portion and support the lower portion of the frame. Each rod includes an abutment that is held in place by the upper portion by a pair of spaced-apart standout members wherein the rod suspends from its corresponding abutments between the spaced-apart members where the abutment straddles and abuts the standout members. In this manner, the resulting T-shape of the abutment and the rod provide structural load bearing capacity as well as a toolless method for removing the lower portion of the frame when accessing the collection containers.

The frame may also include a back plate that is incorporated in the lower portion of the frame and supports the bottles from the rear. The back plate may also include at least one handgrip for ease in handling. It is also contemplated in the present invention that the lower portion may be vertically adjustable along the rods relative to the upper portion.

The present invention also relates to a method of fresh water recapture of idle shower water comprising the steps of first providing a movable flow water diverter assembly that diverts, collects, and directs idle shower water into a collection container, where the diverter assembly moves from a first water diverting position to a second non-water diverting position. Secondly, the method provides for moving the diverter assembly from its first position to its second position during showering to recapture idle water. In preferred form, the collected water is stored in sealable collection containers for later use. Further, the diverter assembly includes a rotatable arm, a collection basin integral with the arm, and a flow director that directs water flow from the basin to the collection container.

The main advantages of the present invention include 1) an environmentally-friendly way to recapture fresh water that would otherwise be wasted; 2) economically feasible device for the aftermarket; 3) relatively unobtrusive and an easy-to-use rotatable water flow diverter arm that moves from a first to a second position with one hand; 4) a space saving all-in-one shower caddy including pocket structure for shampoo bottles and a rack for wash cloths and the like; and 5) an easily removed lower portion that can function as a separate caddy for stored fresh shower water.

These and other advantages, objects and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, wherein:

FIG. 6 is a side view of the upper portion of the frame and pin for allowing the diverter assembly rotational movement from its first position to its second position;

FIG. 7 is a rear view of the diverter assembly;

FIG. 8 is a side view of an alternate embodiment of the diverter assembly with the arm and diverter assembly shown in the second position in phantom;

FIG. 9 is a front view of the alternate embodiment of the collection container and the frame shown less a backplate and connector prongs; and FIG. 10 is a side view of FIG. 9.

BEST MODE FOR CARRYING OUT THE INVENTION

Figure 1:
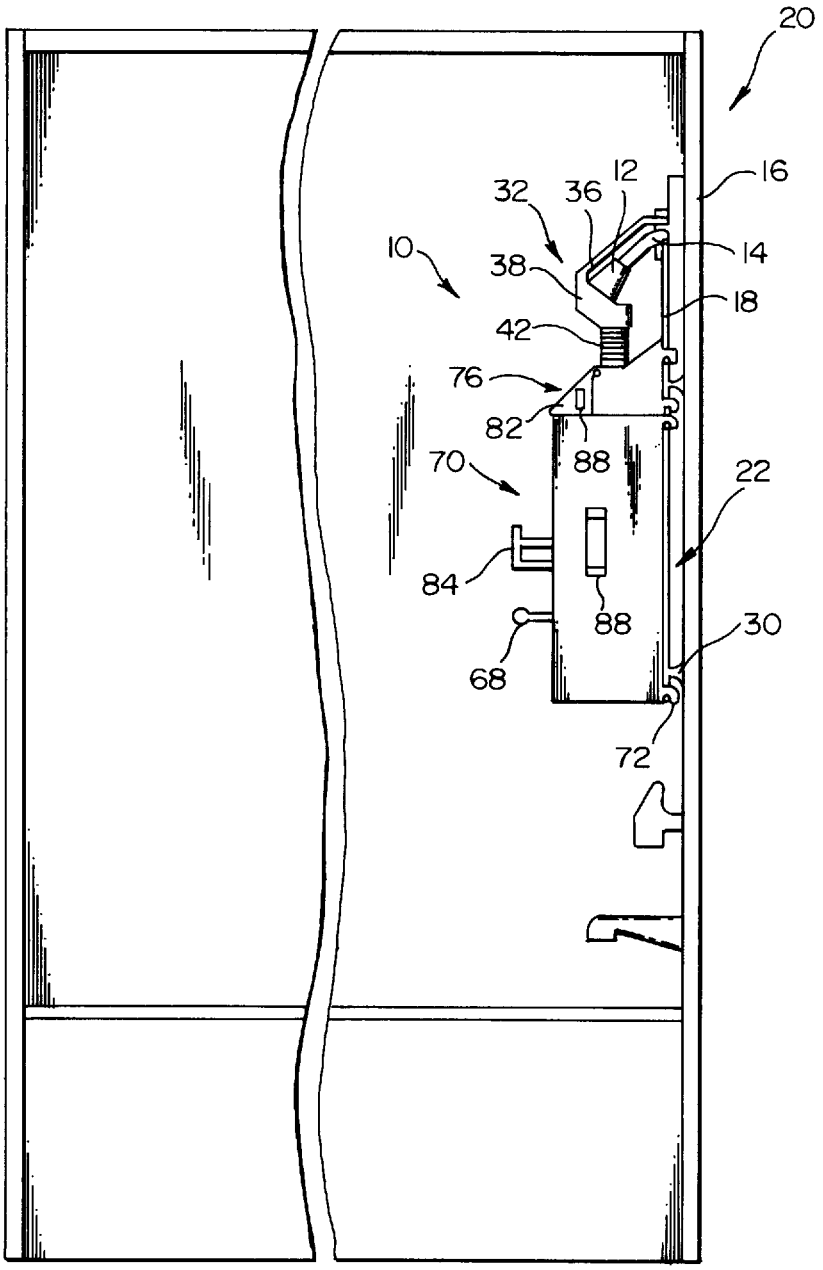
FIG. 1 is a side view of the collection device of the present invention including a shower caddy housing, shown in use.

Referring to FIG. 1, the invention is directed to an apparatus and method for diverting, collecting, recapturing and recycling idle shower water. The apparatus is a collection device 10, which is used in conjunction with a shower head 12, and which extends outwardly from a shower arm 14 that is rigidly attached to a wall 16. Referring also to FIGS. 2–5, device 10 includes a supported frame 18 that is proximate shower head 12 and adjacent wall 16. Frame 18 includes an upper portion 20 and a lower portion 22. Lower portion 22 of frame 18 extends downwardly below shower head 12. Upper portion 20 is preferably mounted above shower head 12, although the invention as claimed would perform satisfactorily with upper portion 20 mounted slightly below shower arm 14.

Lower portion 22 of frame 18 is of a size and shape to receive at least one collection container or bottle 24. In preferred form, the lower portion includes an external pocket assembly 26 that holds the at least one bottle 24. Pocket assembly 26 is designed to hold at least one container 24 that will contain approximately three gallons of water. In one embodiment, lower portion 22 holds up to three bottles 24 (as shown in FIGS. 2–5). FIGS. 9 and 10 show one large bottle 24'.

Figure 5:
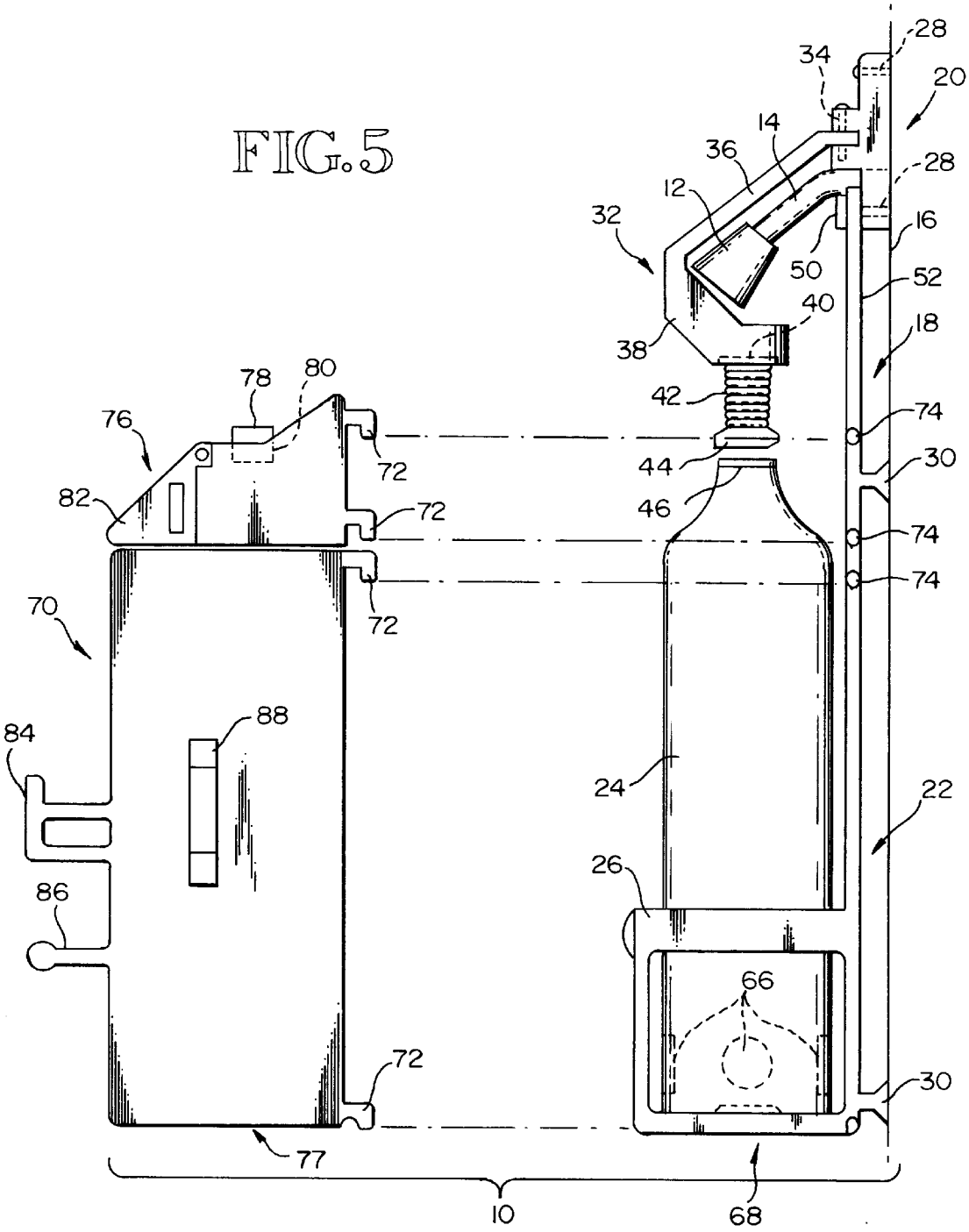
FIG. 5 is a side view of the that of FIG. 4 except showing another embodiment of the housing including a separate hood.

The upper portion 20 of frame 18 is preferably mounted to wall 16 through a plurality of lag bolts 28 (shown in FIG. 5). The upper portion, includes an aesthetically-pleasing, downwardly extending, parabola-shaped plate 25 that includes a plurality of openings 27 to receive the lag bolts 28. As generally discussed above, plate 25 surrounds shower arm 14 above the shower head 12, but does not need to rest on or be supported by shower arm 14. The lower portion 22 is preferably secured to wall 16 through a plurality of suction cups 30. Cups 30 may include adjustable length arms (not shown) to adjust the return distance to the wall. The lag bolts and suctions cups secure frame 18 to wall 16.

Figure 3:
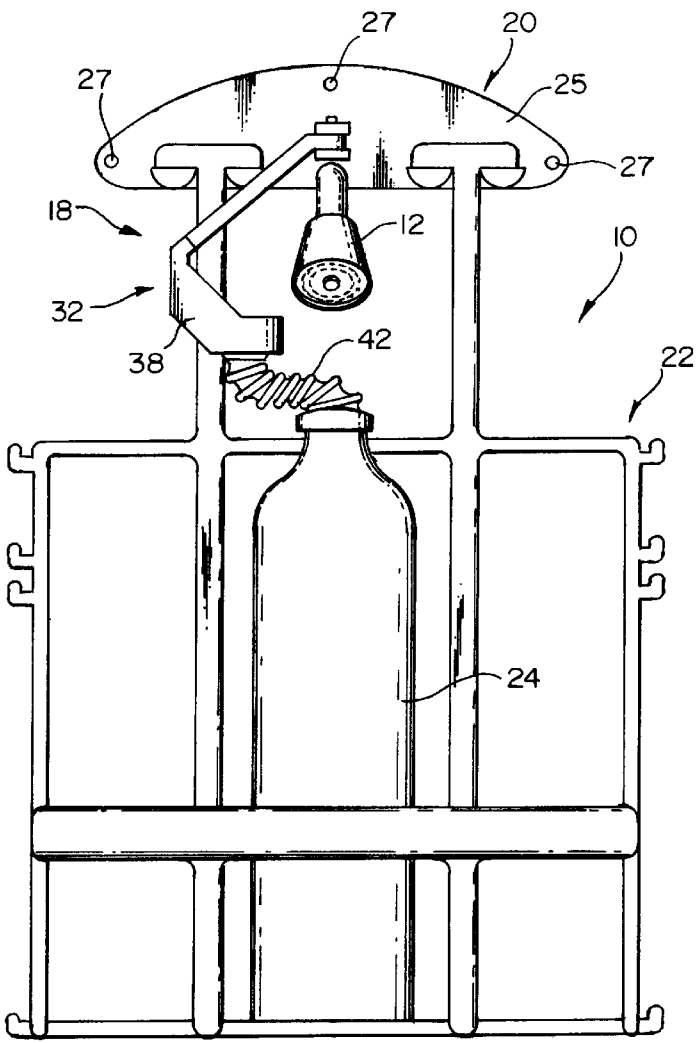
FIG. 3 is a view like FIG. 2 except the diverter assembly is shown in its second "at rest" position.

Referring also to FIGS. 6–7, device 10 also includes a movable water flow diverter assembly 32 that is rotatably connected to plate 25 by means of a pin 34 (shown in FIGS. 5 and 6). This pin connection allows the diverter assembly 32 to move from a first "in use" position, as shown in FIGS. 1, 2, 4, and 5, to a second "at rest" position as shown in FIG. 3. However, other means may be used to provide movement of the diverter assembly between two positions. Other means may include, but are not limited to, a pivot to allow the whole assembly to move upwardly at a pivot or joint located at plate 25 or a means for entirely removing and repositioning the diverter assembly into position, such as a pin and socket configuration (not shown) where a pair of elongated pins extend downwardly from diverter assembly 32 and are engageable with corresponding sockets on the upper portion 20.

Diverter assembly 32 includes an elongated arm 36, a collection basin 38 that is connected to (and may be integral with) arm 36, and a flow director 42. The proximate end of arm 36 is connected to plate 25 at pin 34. Thus, as the arm 36 moves, the basin and at least a portion of the flow director move with the arm.

Although the arm 36 is best shown angled approximately 45 degrees to closely align the shower head 12 and as an aesthetic choice, FIGS. 8–10 disclose an alternate embodiment diverter assembly 32' with an alternate embodiment arm 36' designed especially for an oversized shower head. The alternate embodiment arm 36' is jointed at an elbow 48 that allows the entire diverter assembly to move upwardly above the bather. Additionally, arm 36' may be vertically adjustable (e.g. telescoping) at adjustment point 49.

Both arms 36 and 36' may also include an additional joint 55 located on arm 36, 36' where the collection basin 38 is connected to arm 36, 36' at joint 55. Preferably, basin 38 is rotationally-attached to allow rotation of the basin when the diverter assembly is moved from the first to second position. In this manner, basin 38 is able to face wall 16 when the diverter assembly is in the second (at rest) position to minimize any exposure to contaminants (such as soap).

Arm 36, 36' is preferably made from man-made materials for economic and weight considerations. A reinforcing metal rod may be inserted into the arm depending on the use requirements (i.e. residential versus commercial). Other light-weight, noncorrosive materials may also be used, such as aluminum or plated chrome.

Basin 38 extends downwardly and inwardly of arm 36, 36' and is of a size and shape to surround the portion of the shower head from which the flow of water is emitted. Basin 38 diverts and collects water flow from shower head 12. Basin 38 also includes an approximately 2 inch opening 40 that engages a flow director 42, which may be a flexible, corrugated, variable-length pipe with a seal 44 at its distal end, as shown. Preferably, flow director 42's proximate end includes a flange that estops the flexible pipe 42 from exiting opening 40 of basin 38.

The flow director may also be in the form of a funnel or other channeling means in which to move the diverted and collected water from the shower head to bottle 24.

In alternate embodiment diverter assembly 32', the flow director may be readily removable from basin 38 and its aperture 40 so as to reduce obstruction to the bather when the diverter assembly 32 is in the at rest position.

Referring again to FIGS. 2–5 and 9–10, each bottle 24 holds approximately one gallon of water. Bottle 24' holds approximately three gallons of water. Both bottles 24, 24' include an opening 46 that engages seal 44 in order to channel the water in an uncontaminated manner. Each bottle may also include a handle 53 (shown only in FIG. 10) positioned near opening 46 in order to easily access filled bottle 24 during reuse. Each bottle may also include a plurality of frangible openings 66 positioned near the base of each bottle for additional access means. Bottle 24' is also shown with handle grips 57 for ease in handling. Both bottles 24, 24' also include feet 59 for added stability when being transported or in use as a portable water container.

Figure 2:
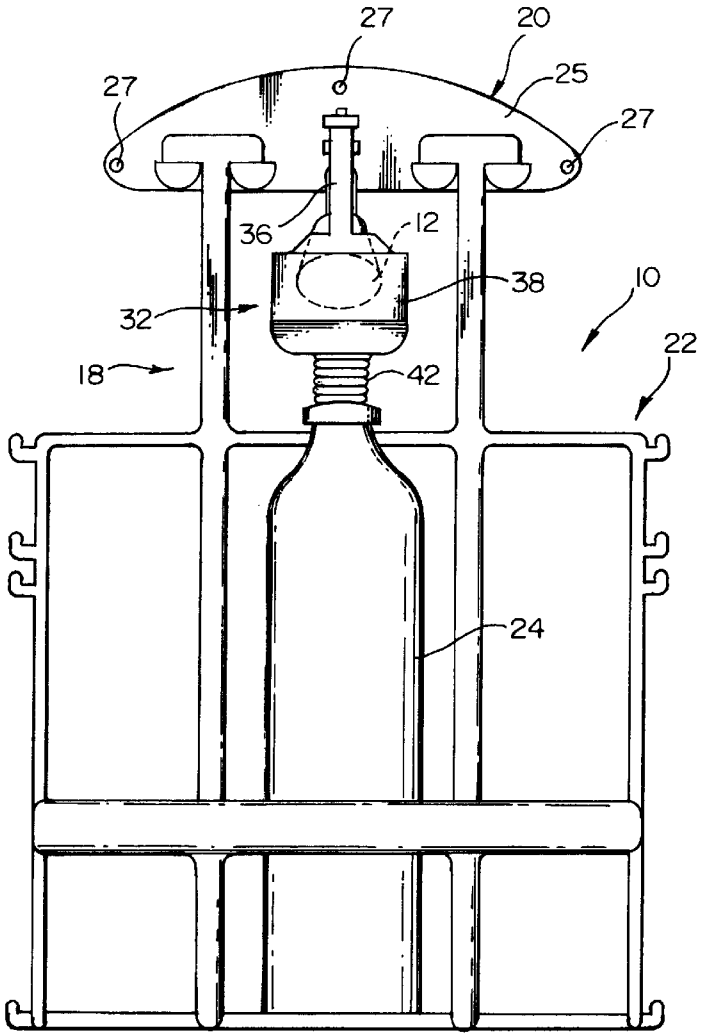
FIG. 2 is a front view of the collection device shown with the frame, less the back plate and less the housing and showing the moveable water flow diverter assembly in its first "in use" position.
Figure 4:
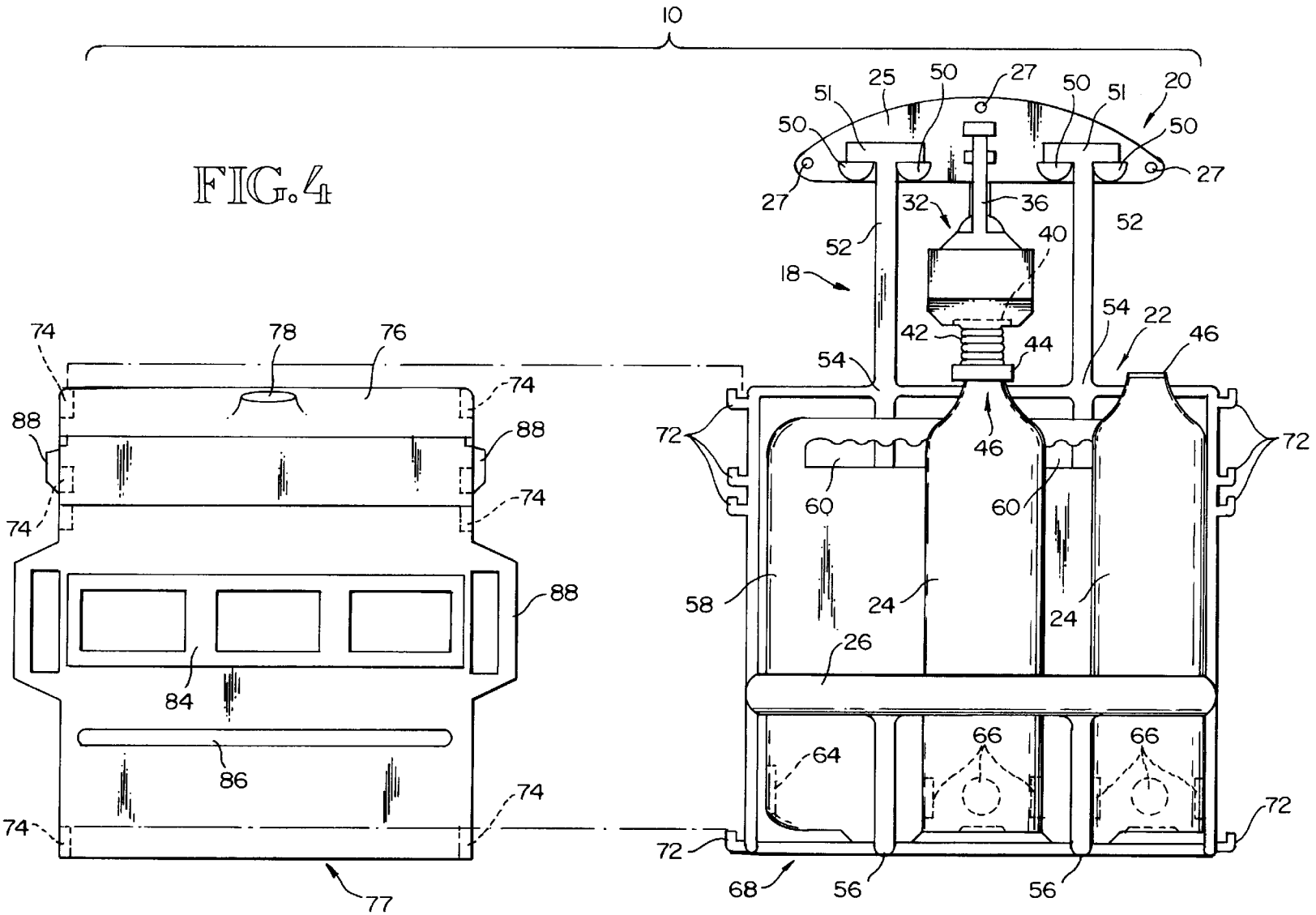
FIG. 4 is a front view of the collection device showing the housing prior to being attached to the frame.

In use, the seal 44 seals opening 46 such as shown in FIG. 4. When the diverter assembly 32 is moved from its first position to its second position, the accordian-like flexibility of flow director 42 allows seal 44 to remain engaged with opening 46 when moved from the first to the second position as shown in FIGS. 2 and 3.

Referring to FIGS. 4 and 5, frame 18 includes two sets of spaced-apart standout members 50 that in connection with a pair of rigid elongated rods 52 suspend lower portion 18 from upper portion 20. Each rod 52 includes an abutment 51 that straddles and abut stand-out members 50 such that the rods 52 suspend from abutments 51 and are positioned between the spaced-apart stand-out members. The T-shape provides the structural strength to bear a load of approximately 3 gallons of water. Moreover, the T-shape allows for toolless removal of the lower portion of the frame for ease in cleaning, and accessing the collection containers. The design also provides a sizeable window for the shower head, so that there is no interference with the shower head.

Rods 52 may be threaded (not shown) to allow adjustment in placement of lower portion 18 on wall 16. This might be especially helpful for those individuals challenged by height. If height adjustability is required, a threaded nut and washer (not shown) would be placed at points marked 54 and 56 to support frame on rods 52.

The lower portion of the frame may also include a back plate 58, which supports bottles 24 when lower portions 22 is removed for further storage/support of the collected water containers (FIGS. 4, 5). The back plate 58 includes a pair of handgrips 60 for ease in gripping during removal of the lower portion of the frame from the upper portion.

It is also a feature of the present invention that the frame also include frangible openings 64 that correspond to frangible openings 66 at the bottom of bottles 24. In the event that emergency water is needed, such as in an earthquake, the lower portion 22 can be readily removed, as discussed above. The stored water may be additionally accessed through frangible openings 64, 66 by a spout or other device (not shown). The lower portion of the frame may also include a planar base 68 for added stability when the lower frame is placed on a table or other flat surface.

In use, the device is readily mounted to wall 16 around shower head 12. No plumbing or complicated devices are needed. Once mounted, the device is easy to use. When a user does not need access to the flow of water from the shower head, such as when shampooing, lathering, or adjustment of water temperature, the user positions the diverter assembly 32 in the first position so that fresh idle shower water is diverted, recaptured, and channeled into a collection container 24, 24'. The diverter assembly can be moved with one hand. If a first bottle is filled up, a cap (not shown) may be placed over the first bottle 24 and the second bottle may be connected to flow director 42. When the bather needs access to the shower flow, the diverter assembly arm is moved to the second position and the water flow is not diverted and recaptured.

The present invention also provides for an aesthetically-pleasing, functional housing 70, which is designed to fit lower portion 18 at pre-designated prongs 72 that are received within openings 74 on housing 70. Other well known attachment means may also be used. Housing 70 may also include a hood 76 that is designed to cover housing 70 and over openings 46 of each bottle 24. Hood 76 may either be a separate member as shown in FIG. 5 or unitary with housing 70 as shown in FIG. 4. If hood 76 is a separate member, hood 76 may be used by itself without the rest of housing 70.

One of the main benefits of hood 76 is that it further aids in the collection of uncontaminated water by shielding contaminants such as soap and shampoo away from the bottle opening 46. When hood 76 is used, seal 44 is engaged with a flanged opening 78 on top of hood 76. As shown best in FIG. 5, flanged opening 78 includes a lower member 80 that engages with opening 46 of bottle 24. Hood 76 may also include a hinged front member 82 that allows easy access to bottle openings 46 of bottles 24 without removing hood 76 in its entirety.

Housing 70 may also include an exterior pocket structure 84 of a size and shape to receive other bottles and containers, such as shampoo and the like. A wash cloth rack 86 may also be included. For further ease in placing or removing the hood and/or housing, a pair of oppositely-situated, spaced-apart handles 88 are included on each side housing 70 and each side of hood 76. Housing 70 also includes a planar base 77 to allow the entire frame and housing to be removed and capable of remaining stationary when the base 77 abuts a flat surface.

In yet another embodiment, housing 70 may also include a split down the middle of housing 70 with hinged side members (not shown) to allow access to bottles 24, 24'.

The present invention may also include a removable cardboard template (also not shown) that has frangible openings for determining hole placement for drilling purposes. This template aids in placement of the lag bolts 28.

The present invention is designed to be easy-to-use and economical. The frame, bottles, diverter assembly, and housing may all be made from man-made materials for strength, durability, ease in manufacturing, noncorrosiveness, and cost savings. The housing, frame, and diverter assembly may be injection molded and be color accented to blend with common decorator themes.

The present invention is also directed to a method of recapture of fresh idle shower water where a diverter assembly is moved between a first and second position to divert and collect the idle water when the diverter assembly is in the first position. The method provides for collection of the diverted water into collection bottles that may be accessed for future use.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A collection device for recapture of a flow of fresh water released from a shower head, wherein the shower head extends outwardly from a shower arm attached to a wall, the device comprising:

a supported frame proximate the shower head and adjacent the wall, said frame having an upper portion and a lower portion, wherein said lower portion extends downwardly below the shower head, said lower portion being of a size and shape to receive at least one collection container; and a moveable water flow diverter assembly having a first in use position and a second at rest position, said diverter assembly including an arm that is connected to the frame, a collection basin connected to the arm, and a flow director that directs the water flow from the basin to the at least one collection container;

wherein said basin extends downwardly and inwardly of the arm and is of a size and shape to surround the portion of the shower head from which the water is released when the arm is positioned around the shower head in order to divert and direct water into a lower portion of the basin and into the flow director; and wherein each container includes an opening that is engageable with the flow director such that any diverted water is uncontaminated as it is collected into the container through the opening when the diverter assembly is in its first position;

wherein, in use, a user moves the diverter assembly into the first position wherein the basin diverts the flow of water from the shower head and collected water is stored in the at least one container for later use when the user does not need access to the water flow, and, alternatively, the user moves the diverter assembly into the second position, wherein the basin is moved away from the shower head and does not divert the flow of water, when the user needs access to the flow of water.

2. The collection device according to claim 1, wherein the flow director includes a flexible pipe having a proximal end engaged with an aperture defined by a lower portion of said basin, and wherein a seal is located at the pipe's distal end to engage with the opening of the at least one collection container.

3. The collection device according to claim 2, wherein the flexible pipe can vary in length.

4. The collection device according to claim 3, wherein the arm of the water flow diverter assembly is rotatably connected to the upper portion of the frame.

5. The collection device according to claim 4 further comprising a housing attachable to the frame, said housing being of a size to cover the opening of the at least one collection container.

6. The collection device according to claim 5, wherein the housing includes a hood having a flanged opening that covers the housing as well as over the opening of at least one collection container and wherein an external portion of the flanged opening within the hood engages the seal of the flexible pipe and an interior portion of the flanged opening is proximate the opening of the at least one container.

7. The collection device according to claim 6, wherein the hood includes an operable hinged front door.

8. The collection device according to claim 5, wherein the housing further includes oppositely-situated, spaced-apart, handles that extend externally of the housing.

9. The collection device according to claim 5, wherein the housing includes a exterior pocket structure of a size and shape to hold at least one shampoo bottle.

10. The collection device according to claim 9, wherein the housing further includes a rack for holding a wash cloth.

11. The collection device according to claim 5, wherein the housing further includes a planar base.

12. The collection device according to claim 2, wherein the arm of the water flow diverter assembly is rotatably connected to the upper portion of the frame.

13. The collection device according to claim 1, wherein the arm of the water flow diverter assembly is rotatably connected to the upper portion of the frame.

14. The collection device according to claim 1, wherein the collection basin is pivotally attached to the arm of the diverter assembly.

15. The collection device according to claim 1, wherein the frame is attached to the wall.

16. The collection device according to claim 1, further comprising a housing attaching to the frame, said housing being of a size and shape to cover the at least one opening of the collection container.

17. The collection device according to claim 1, wherein the lower portion of the frame is suspended from at least two elongated rods each having an abutment, wherein in each rod is supported by a set of spaced-apart standout members that are fixedly attached to said upper portion of the frame and wherein each said abutment contacts and straddles one said set of standout members with the corresponding rods suspended from the abutment between the standout members.

18. The collection device according to claim 17, wherein the lower portion further includes a back plate having at least one handgrip, and wherein said back plate supports the at least one collection container.

19. The collection device according to claim 18, wherein the lower portion of the frame is vertically adjustable along the rods relative to the upper portion.

20. The collection device according to claim 1, wherein said at least one collection container can hold approximately three gallons of fluid.

* * * * *